US006474241B2

(12) United States Patent
Theurer et al.

(10) Patent No.: US 6,474,241 B2
(45) Date of Patent: Nov. 5, 2002

(54) MACHINE AND METHOD FOR REMOVING AN OLD TRACK AND LAYING A NEW TRACK

(75) Inventors: Josef Theurer, Vienna (AT); Manfred Brunninger, Altenberg (AT)

(73) Assignee: Franz Plasser Bahnbaumaschinen-Industriegesellschaft m.b.H., Vienna (AT)

( * ) Notice: Subject to any disclaimer, the term of this patent is extended or adjusted under 35 U.S.C. 154(b) by 0 days.

(21) Appl. No.: 09/873,679

(22) Filed: Jun. 4, 2001

(65) Prior Publication Data

US 2001/0050023 A1 Dec. 13, 2001

(30) Foreign Application Priority Data

Jun. 9, 2000 (AT) ..... 432/00 U

(51) Int. Cl.[7] ..... E01B 29/00
(52) U.S. Cl. ..... 104/9; 104/2; 104/7.1
(58) Field of Search ..... 104/2, 6, 7.2, 7.1, 104/7.3, 9, 8

(56) References Cited

U.S. PATENT DOCUMENTS

| | | | | |
|---|---|---|---|---|
| 4,046,077 A | * | 9/1977 | Theurer et al. | 104/2 |
| 4,236,452 A | * | 12/1980 | Theurer et al. | 104/2 |
| 4,794,861 A | * | 1/1989 | Theurer et al. | 104/2 |
| 5,193,461 A | * | 3/1993 | Theurer et al. | 104/7.1 |
| 5,357,867 A | | 10/1994 | Theurer et al. | |

* cited by examiner

*Primary Examiner*—Mark T. Le
(74) *Attorney, Agent, or Firm*—Collard & Roe, P.C.

(57) ABSTRACT

A machine for removing an old track and for simultaneously laying a new track on a ballast bed, which comprises a first tie transport apparatus for receiving the old ties, and a second tie transport apparatus for delivering new ties and laying the new ties. A lifting device may be selectively placed in an operating position on the first or the second tie transport apparatus for insertion between the ballast bed and an old tie for engaging the old tie and lifting it off the ballast bed. This may be done by selectively coupling the lifting device to a respective tie transport apparatus, or by driving the lifting device on each tie transport apparatus between operative and inoperative positions.

5 Claims, 2 Drawing Sheets

MACHINE AND METHOD FOR REMOVING AN OLD TRACK AND LAYING A NEW TRACK

BACKGROUND OF THE INVENTION

1. Field of the Invention

The present invention relates to a machine and method for removing an old track comprised of old rails and old ties from a ballast bed, and for simultaneously laying a new track comprised of new rails and new ties. The machine comprises a first tie transport apparatus for receiving the old ties, the first tie transport apparatus including a lifting device insertable between the ballast bed and an old tie for engaging the old tie and lifting it off the ballast bed, and a second tie transport apparatus for delivering the new ties and laying the new ties.

2. Description of the Prior Art

A machine of this type has been disclosed in U.S. Pat. No. 5,357,867. This machine may be used in track renewal operations while moving it in one direction to replace an old track by new ties and rails, and in the opposite direction to lay a new track on a prepared ballast bed. During the track renewal operation, the machine is advanced in the one direction while supported on a crawler vehicle on a planar surface section from which the old track has been removed and the ballast has either been removed or planed by a ballast bed planing device preceding the planar surface section in the one direction. The new ties are laid and the new rails are deposited thereon behind the crawler vehicle. The new track is laid while the machine is advanced in the opposite direction, for which purpose the machine must be retrofitted by mounting the crawler vehicle on the machine frame ahead of the transport apparatus for the new ties, with respect to the opposite direction. Furthermore, a lifting device of the transport apparatus for the new ties must be turned around to face the opposite direction. At the same time, the transport apparatus for the old ties and the ballast bed planing device are raised into an inoperative position.

SUMMARY OF THE INVENTION

It is the primary object of this invention to provide a machine and method for the renewal of a track, which requires a minimum of retrofitting when the operating direction is reversed.

This and other objects are accomplished in accordance with one aspect of the invention with a machine for removing an old track comprised of old rails and old ties from a ballast bed, and for simultaneously laying a new track comprised of new rails and new ties, which comprises a first tie transport apparatus for receiving the old ties and a second tie transport apparatus for delivering the new ties and laying the new ties. According to the present invention, a lifting device is selectively placeable in an operating position on the first or second tie transport apparatus for insertion between the ballast bed and an old tie for engaging the old tie and lifting it off the ballast bed. This may be done with a coupling device on each tie transport apparatus for detachably affixing the lifting device to the first or the second tie transport apparatus. It is also possible for each tie transport apparatus to include the lifting device, in which case a drive selectively moves each tie lifting device between an operating position for receiving an old tie and an inoperative position.

The operating direction of a machine having the above-described structures may be reversed when a track renewal is effected without any retrofitting. This may be of substantially advantage, for example when a double track is to be renewed. In this case, the machine may be advanced in one direction for removing and laying one rail, and then advanced in the opposite direction on the second track for continuing the renewal work without having to turn around the entire machine in a complicated and time-consuming retrofitting operation. All that is required is to disconnect the lifting device for the old ties from the first tie transport apparatus and to mount it on the second tie transport apparatus, or selectively to move each tie lifting device between an operating position for receiving an old tie and an inoperative position. It is an added advantage that such a machine makes it possible to approach an operating site, where the track is to be renewed, from either direction without having to take the orientation of the machine into consideration.

The track renewal method of the present invention comprises engaging the old ties with a first tie transport apparatus including a tie lifting device for lifting the old ties off the ballast bed and removing the lifted old ties with a first tie conveying device moving in a conveying direction, and simultaneously delivering the new ties to a second tie transport apparatus with a second tie conveying device moving in a conveying direction and laying the new ties on the ballast bed with a second tie transport apparatus. The machine is enabled to reverse the operating direction by detaching the tie lifting device from the first transport apparatus and connecting it with the second tie transport apparatus, and reversing the conveying directions of the first and second tie conveying devices.

BRIEF DESCRIPTION OF THE DRAWING

The above and other objects, advantages and features of this invention will become more apparent from the following detailed description of certain now preferred embodiments thereof, taken in conjunction with the accompanying drawing wherein.

DETAILED DESCRIPTION OF THE PREFERRED EMBODIMENTS

Figure 1:
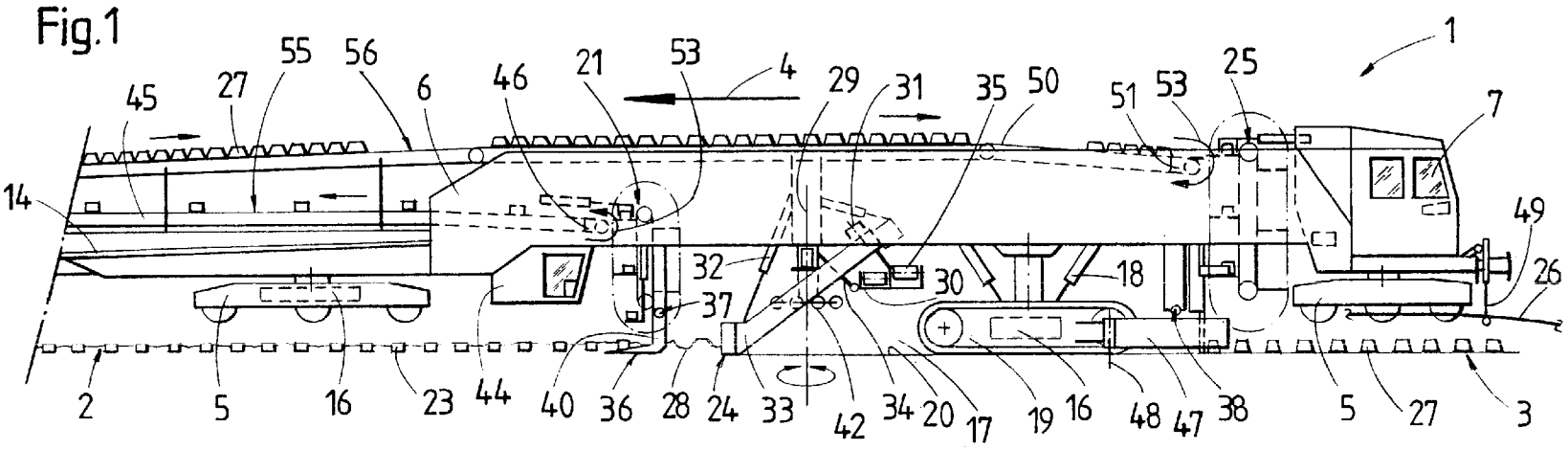
FIG. 1 is a side elevational view of a track renewal machine according to the invention, in a first operating direction.

Referring now to the drawing, FIG. 1 illustrates machine 1 for removing old track 2 comprised of old rails 22 and old ties 23 from ballast bed 28, and for simultaneously laying new track 3 comprised of new rails 26 and new ties 27. The machine comprises machine frame 5, which may run on the old and new tracks in an operating direction indicated by arrow 4 on vertically adjustable undercarriages 5, 5 supporting the machine frame on the tracks. Driver's and operator's cab 7 is mounted at one end of the machine frame while its opposite end is supported by universal coupling joint 8 on frame 9 of tie conveying car 10 running on old track 2 on undercarriages 11, 11. A number of tie transport cars 12 (not shown in detail) are coupled to tie conveying car 10. Gantry crane 13 runs on rails 14 along cars 10 and 12 up to joint 8 coupling machine 1 to the tie conveying car. A central power plant 15 is mounted on tie conveying cars 10 to supply energy to drive 16 and all other operating drives of the train.

At operating site 17, machine 1 is placed over exposed subgrade 20 from which the ballast and track has been removed. To support machine frame 6 during the track renewal operation, a crawler vehicle 19 is lowered onto the subgrade by drives 18 vertically adjustably connecting the crawler vehicle to the machine frame, and the machine runs on the crawler vehicle while track-bound undercarriages 5, 5 are raised into an inoperative position off the old and new tracks.

First tie transport apparatus 21 for receiving old ties 23 precedes crawler vehicle 19 in the operating direction indicated by arrow 4 and second tie transport apparatus 25 for delivering new ties 27 and laying the new ties trails the crawler vehicle in the operating direction.

Figure 3:
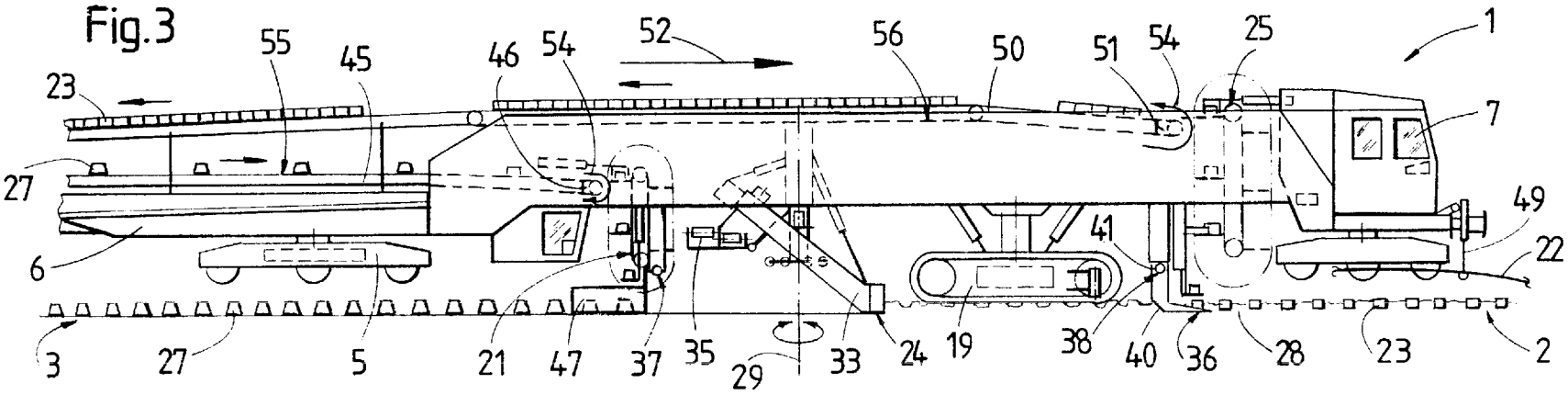
FIG. 3 shows the machine of FIG. 1, in the opposite operating direction.

Ballast bed planing device 24 positioned between first tie transport apparatus 21 and the crawler vehicle excavates the ballast from bed 28 to produce the exposed subgrade 20. The ballast bed planing device is mounted on machine frame 6 for 180° rotation about vertical axis 29 to be turned around into the position shown in FIG. 3 when the operating direction is reversed, as shown by arrow 52 in FIG. 3. The illustrated ballast bed planing device comprises endless excavating chain 33 which may be revolved by drive 31 and extends in a plane inclined with respect to the track. Drives 32 connect the ballast bed planing device to machine frame 6 for vertical adjustment of the device. Two ballast conveyor bands 35 are arranged above subgrade 20 and below a discharge point of excavating chain 33 to receive the excavated ballast. Conveyor bands 35 extend transversely to the track to convey the excavated ballast to a respective track shoulder. The conveyor bands are mounted on common carrier frame 30 and a parallelogram linkage 34 connects the common carrier frame to ballast bed planing device 24 for vertically adjusting the position of the conveyor bands about axes extending perpendicularly to the track.

Figure 4:
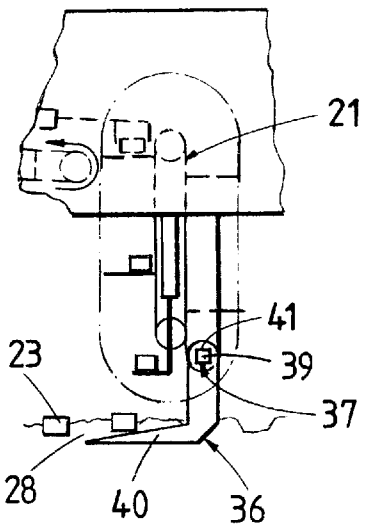
FIG. 4 is an enlarged detailed view of one embodiment of the tie lifting device.

A lifting device 36 is in an operating position on only one tie transport apparatus 21 or 25 for insertion between ballast bed 28 and an old tie 23 for engaging the old tie and lifting it off the ballast bed. According to one embodiment of the invention shown in FIGS. 1, 3 and 4, a coupling device 37, 38 on each tie transport apparatus 21, 25 enables the lifting device to be detachably affixed to a selected tie transport apparatus. As illustrated more clearly in FIG. 4, lifting device 36 has the form of a fork lift 40. Each coupling device comprises essentially a bolt 39 which may be inserted in aligned bores 41 in the tie transport apparatus and fork lift 40 to affix the fork lift immovably, but detachably, to the selected tie transport apparatus.

The operating direction of the machine may be reversed by detaching lifting device 36 from first tie transport apparatus 21 and connecting it with second tie transport apparatus 25, and reversing the conveying directions of first and second tie conveying devices 55, 56.

Figure 5:
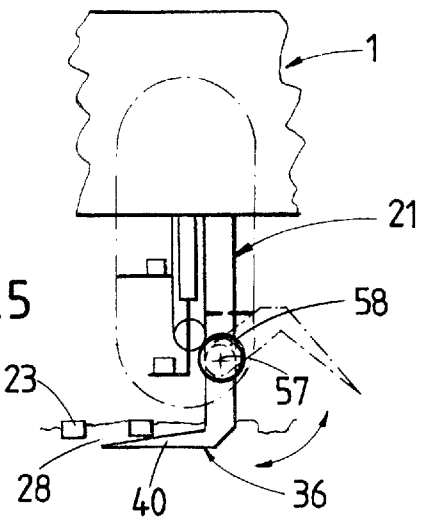
FIG. 5 is an enlarged detailed view of another embodiment of the tie lifting device.

In the embodiment illustrated in FIG. 5, each tie transport apparatus includes the above-described lifting device 36 which is selectively placed in an operating position on tie transport apparatus 21 or 25 by a drive 58 for moving each tie lifting device 36 about horizontal pivot axis 57 between an operating position for receiving an old tie (shown in full lines) and an inoperative position (shown in phantom lines). When machine 1 is driven in one operating direction, the lifting device is in the operating position on one tie transport apparatus for picking up old ties while it is in the inoperative position on the other tie transport apparatus, which is used for laying the new ties. When the operating direction of the machine is reversed, the lifting device is placed in the inoperative position on the one tie transport apparatus while it is placed in the operating position on the other tie transport apparatus, i.e. the positions are reversed. The ballast bed planing device 24, which is arranged between the first and second tie transport apparatus 21, 25 for planing ballast bed 28, is turned 180° when the operating direction is reversed, whereby new ties 27 are always laid on a planed ballast bed.

Figure 2:
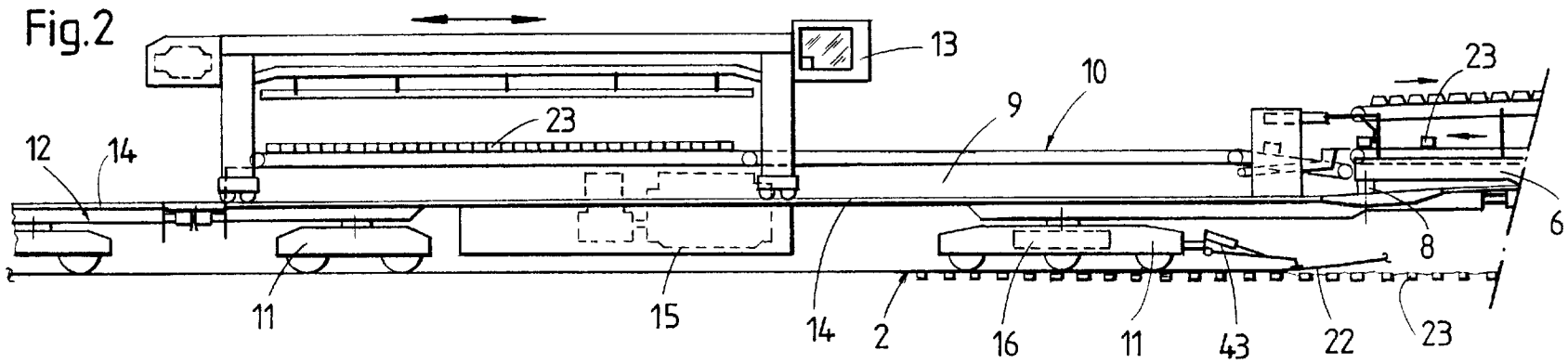
FIG. 2 is a side elevation view of a tie conveyance and storage car coupled to the track renewal machine of FIG. 1.

In operation, machine 1 is placed in position at track renewal site 17 with the aid of an auxiliary carriage 42 which is vertically adjustably mounted on machine frame 6, and is then supported by crawler vehicle 19 lowered onto the planed surface by drives 18. As the machine is driven in the operating direction indicated by arrow 4 in FIG. 1, old rails 22 of old track 2 are lifted off old ties 23 and removed by rail guiding device 43 (diagrammatically shown in FIG. 2). The old ties are then engaged with tie lifting device 36 on first tie transport apparatus 21 and lifted off ballast bed 28, and the lifted old ties are removed with tie conveyor 45 of first tie conveying device 55. Drive 46 moves the tie conveyor in a conveying direction 53. Old ties 23 are conveyed in the operating direction indicated by arrow 4 to tie conveying car 10 (FIG. 2) where they are stacked, and the stacks of old ties are then transported by gantry crane 13 to tie transport cars 12.

As the old track is removed during the advance of machine 1, excavating chain 33 is revolved to excavate the ballast and expose subgrade 20, and the excavated ballast is conveyed to one or the other track shoulder by transverse ballast conveyor bands 35. Which of the two transverse ballast conveyor bands discharges the excavated ballast to which track shoulder is determined by swinging one or the other conveyor band under the ballast discharge point of excavating chain 33 with the aid of parallelogram linkage 34. Crawler vehicle 19 runs on planed subgrade 20 and compacts the same as it moves. Vertical shields 47 are hinged to the sides of the crawler vehicle and may be pivoted about vertical axes 48 to prevent the ballast deposited on the track shoulders from flowing back to the planed track bed. Simultaneously, the new ties 27 are delivered to second tie transport apparatus 25 with tie conveyor 50 of second tie conveying device 56. Drive 51 moves the tie conveyor in the conveying direction 53 and the new ties are laid with second tie transport apparatus 25. New rails 26 are laid on new ties 27 by rail guide devices 49 mounted on machine frame 6.

When the operating direction of machine 1 is reversed, as indicated by arrow 52 (FIG. 3), ballast bed planing apparatus 24, with transverse conveyor bands 35, is turned 1800 about vertical axis 29. Fork lift 40 of lifting device 36 is detached from first tie transport apparatus 21 and affixed by coupling device 38 to second tie transport apparatus 25 for receiving old ties 23, from which old rails 22 have been removed by rail guide devices 49. Drive 51 of tie conveyor 50 is reversed from a first rotary direction 53 into rotary direction 54, and old ties 23 are conveyed by tie conveying device 56 to tie transport car 10.

Crawler vehicle 19, which trails second tie transport apparatus 25 in the operating direction, runs on exposed ballast bed 28 and is planed by trailing excavating chain 33 of ballast bed planing apparatus 24. Shields 47 are mounted on first tie transport apparatus 21, and the conveying direction 54 of tie conveyor 45 of first tie conveying device 55 is reversed to deliver new ties 27 for laying the new track in a manner analogous to the above-described procedure.

What is claimed is:

1. A machine for removing an old track comprised of old rails and old ties from a ballast bed, and for simultaneously laying a new track comprised of new rails and new ties, which comprises (a) a first tie transport apparatus for receiving the old ties, (b) a second tie transport apparatus for delivering the new ties and laying the new ties, (c) a lifting device selectively placeable in an operating position on the first or second tie transport apparatus for insertion between the ballast bed and an old tie for engaging the old tie and lifting it off the ballast bed, and (d) a coupling device on each tie transport apparatus for detachably affixing the lifting device to the selected tie transport apparatus.

2. The machine of claim 1, further comprising a ballast bed planing device arranged between the first and second tie transport apparatus for planing the ballast bed whereby the new ties are laid on a planed ballast bed.

3. A method for removing an old track comprised of old rails and old ties from a ballast bed, and for simultaneously laying a new track comprised of new rails and new ties on the ballast bed, with a machine moving in an operating direction, which comprises (a) engaging the old ties with a first tie transport apparatus including a tie lifting device for lifting the old ties off the ballast bed and removing the lifted old ties with a first tie conveying device moving in a conveying direction, (b) simultaneously delivering the new ties to a second tie transport apparatus with a second tie conveying device moving in a conveying direction and laying the new ties with the second tie transport apparatus, and (c) enabling the machine to reverse the operating direction by (1) detaching the tie lifting device from the first transport apparatus and connecting it with the second tie transport apparatus, and (2) reversing the conveying directions of the first and second tie conveying devices.

4. The method of claim 3, further comprising the step of planing the ballast bed between the first and second tie transport apparatus with a ballast bed planing device rotatable about a vertical axis, and turning the ballast bed planing device 180° when the operating direction of the machine is reversed.

5. A machine for removing an old track comprised of old rails and old ties from a ballast bed, and for simultaneously laying a new track comprised of new rails and new ties, which comprises (a) a first tie transport apparatus for receiving the old ties, (b) a second tie transport apparatus for delivering the new ties and laying the new ties, (c) a lifting device on each tie transport apparatus for insertion between the ballast bed and an old tie for engaging the old tie and lifting it off the ballast bed, and (d) a drive for selectively moving each lifting device between an operating position wherein it engages the old tie and an inoperative position.

* * * * *